United States Patent [19]

Yamazaki et al.

[11] 4,417,807

[45] Nov. 29, 1983

[54] CLEANING APPARATUS FOR RECORDING APPARATUS

[75] Inventors: Yoshio Yamazaki; Ken Nakamura; Shigeru Inowa, all of Hachioji, Japan

[73] Assignee: Konishiroku Photo Industry Co., Ltd., Tokyo, Japan

[21] Appl. No.: 294,393

[22] Filed: Aug. 19, 1981

[30] Foreign Application Priority Data

Sep. 10, 1980 [JP] Japan ..... 55-126412

[51] Int. Cl.[3] ..... G03G 21/00

[52] U.S. Cl. ..... 355/15; 15/256.51

[58] Field of Search ..... 355/3 R, 15; 15/256.51

[56] References Cited

U.S. PATENT DOCUMENTS

| | | | |
|---|---|---|---|
| 3,692,402 | 9/1972 | Solarek | 355/15 X |
| 3,859,691 | 1/1975 | Katayama et al. | 15/256.51 |
| 4,140,388 | 2/1979 | Ikesue | 355/15 |
| 4,165,965 | 8/1979 | Bernardelli et al. | 355/15 X |
| 4,195,927 | 4/1980 | Fotland et al. | 355/3 TR X |
| 4,218,132 | 8/1980 | Iwai et al. | 355/15 |
| 4,314,756 | 2/1982 | Amitani et al. | 355/15 |

FOREIGN PATENT DOCUMENTS

| | | | |
|---|---|---|---|
| 55-135822 | 10/1980 | Japan | 355/15 |

*Primary Examiner*—Fred L. Braun

*Attorney, Agent, or Firm*—Frishauf, Holtz, Goodman & Woodward

[57] ABSTRACT

A recording apparatus includes a toner retaining member such as a photosensitive drum, a toner collector, a cleaning device for cleaning toner off of the toner retaining member, and a toner guide member for guiding toner away from the toner retaining member. The guide member has a plurality of spaced apart front contact end portions in contact with the toner retaining member for guiding toner which is cleaned from the toner retaining member to the toner collector, at least the front contact end portions of the toner guide member which are in contact with the toner retaining member being in a comb-teeth shape. Preferably, at least the front contact end portions of the toner guide member are fibers.

14 Claims, 6 Drawing Figures

CLEANING APPARATUS FOR RECORDING APPARATUS

BACKGROUND OF THE INVENTION

1. Field of the Invention

The present invention relates to an apparatus for cleaning the toner remaining on a toner retaining member after transfer of a toner image, in a recording apparatus such as an electrophotographic copying apparatus and an electrostatic recording apparatus. More particularly, the invention relates to an improvement of a toner guide member which guides toner removed from a toner retaining member to a toner reservoir or to a toner conveying means normally arranged in a place apart from said toner retaining member.

2. Description of the Prior Art

There has so far been known the fact that, in a recording apparatus such as an electrophotographic copying apparatus, the ratio of toner transfer from a toner retaining member to a transfer member does not reach 100%. Therefore, if such a conventional type of recording apparatus continues the toner transfer process, it has the shortcoming that toner remains on a toner retaining member and thus remaining toner is also transferred onto a non-image area of the next transfer member. Therefore, it is necessary to clean up toner remaining on a toner remaining member after a transfer process is completed.

As for a cleaning apparatus for the above purpose, a variety of means have so far been proposed. For example, there have been adopted the fur brush type cleaning method, web type cleaning method, roller type cleaning method and blade type cleaning method. If the toner having been cleaned remains uncollected in a toner reservoir or a toner conveyance means, it causes the shortcomings that said toner is scattered in the apparatus and causes a contamination, and besided that, for example, said toner adheres again onto a toner retaining member before the toner will transfer thereon and thus an image quality becomes worse or a toner cleaning apparatus is overloaded thereby. Accordingly, it is required to collect the toner having been cleaned into a toner reservoir or a toner conveyance means. Therefore, in a toner cleaning apparatus, it is required that the toner remaining on a toner retaining member can be cleaned and that the toner can be collected.

Conventionally, there has so far been known the cleaning apparatus as shown in FIG. 1 and FIG. 2 respectively.

In FIG. 1, the numeral 1 indicates a toner retaining member such as a photoconductor or an insulator, 2 indicates a toner cleaning blade for cleaning toner remaining on a toner retaining member 3, indicates a toner guide member for collecting toner having been cleaned off by the toner cleaning blade 2 and 4 indicates a toner reservoir for storing toner having been collected.

Next, referring to the operation of said apparatus as shown in FIG. 1, toner retaining member 1 rotates in the direction of the arrow, developed to form a toner image, with toner, from an electrostatic latent image having been formed by an optical or an electrical means, and then transfers the thus obtained toner image onto an image transfer material. The toner still remaining on said toner retaining member after a toner image was transferred, passes through toner guide member 3 and the contact surface of toner retaining member 1, and is cleaned off by a cleaning blade 2, and then drops down along the toner retaining member. The thus dropped toner is collected by toner guide member 3 and guided to the toner reservoir. Said guide member 3 is required to collect surely all the remaining toners having been collected by the cleaning blade, without emission, into the toner reservoir. Conventionally, as for said toner guide members, a comparatively thin elastic sheet, for example, a Mylar (a trademark of E. I. Dupont) sheet of 0.1 mm in thickness, is used by bringing it into light contact with a toner retaining member. This method has the advantages that the mechanism thereof is simple and the durability of said elastic sheet serving as a toner guide member is longer. However on the other hand, it has also the essential disadvantages, that it is required to press said elastic sheet forcibly into contact with a toner retaining member in order to reduce the toner leakage, and consequently said toner retaining member 1 is damaged and an image quality is worsened. Further, according to environmental conditions, the front end of said elastic sheet becomes wavy, (i.e., the so-called "wavy phenomenon"), and thus said sheet cannot come into contact with a toner retaining member uniformly, and consequently, for example, the leakage of toner will contaminate the inside of the apparatus. There is also the disadvantage such as a strict requirement in preciseness of processing and fitting of said elastic sheet.

FIG. 2 shows a cleaning apparatus using a roller serving as to a toner guide member. The reference numerals, 1, 2 and 4 are the same as in FIG. 1, so that the explanations thereof are omitted herein. Numeral 5 indicates a roller made of metal, elastic materials or the like. Numeral 6 indicates a scraper for scraping the toner adhered onto and then collected by roller 5 and for collecting them. Roller 5 is brought into light contact with a toner retaining member and is rotated in the direction of the arrow. Next, referring to the operations of the means shown in FIG. 2, a toner image having been formed on a toner remaining member in the similar manner to that in the description of FIG. 1, is transferred onto a toner transfer member, and thereafter, the toner remaining on said toner retaining member passes through roller 5 and the contact surface of said toner retaining member, and then drops down along toner retaining member 1. Thus dropped toner is adhered onto and collected by roller 5, and the toner adhered onto and collected by said roller 5, is scraped by scraper 6 and collected into toner reservoir 4. The apparatus shown in FIG. 2 has the advantage that the so-called wavy phenomenon does not result on the roller and therefore that no toner leakage is caused by said phenomenon, in contrast with the apparatus shown in FIG. 1. On the contrary, this apparatus has the problems that a toner filming phenomenon is caused on a toner retaining member by said roller and thus an image quality is worsened, or that scraper 6 has a resemblance to said elastic sheet 3 in the structure, therefore the so-called wavy phenomenon is caused, and the toner on roller 5 cannot completely be collected, and then the toner adhered on said roller 5 remains and solidifies, thus damaging the toner retaining member. Further, this arrangement has the additional disadvantage that very highly fitting preciseness is requested to fit roller 5.

As for one of the methods of solving the disadvantages in said toner guide members, for example, the method described in Japanese Patent Publication Open to Public Inspection No. 71646/1979 has been proposed.

In this method, a bristlelike or porously elastic body is arranged on a portion coming into contact with a toner retaining member of a toner guide member, and the toner having been caught in the vacant spaces inside said bristlelike or porously elastic body, is scraped by a rotating brush and then collected in a toner reservoir. According to said method, there becomes less of a possibility of damage to a toner retaining member by a toner guide member. On the other hand, this method needs a rotating brush in order to catch and scrape toner in the vacant spaces inside said bristlelike or porously elastic body of the toner guide member. Therefore, the device is larger in size and increases the costs thereof. Further, due to a frictional charge or the like generated in the area between said rotating brush and the bristlelike or porously elastic body of the toner guide member, this method has the disadvantage that toners is adhered and solidified on said area and the toner retaining member is damaged. Also this method has the other disadvantages that the toner remaining on the toner retaining member contaminates the inside of the apparatus, because said toners is scraped on the surface of said bristlelike or porously elastic body to where the toner retaining member is brought into contact with said elastic body, and that the toners remaining thereon is trapped and cohered together, and consequently the toner retaining member is damaged.

SUMMARY OF THE INVENTION

An object of the present invention is to provide a cleaning apparatus, wherein the aforesaid disadvantages are eliminated, a toner retaining member is not damaged, and a novel toner guide member is equipped thereto so that the toner having been cleaned by a cleaning member can be collected without fail.

Another object of the present invention is to provide a cleaning apparatus, wherein no leakage of toner due to the influence of environment such as the so-called wavy phenomenon, can be caused, and a toner guide member is equipped thereto so that said guide member can easily be fitted and a toner retaining member cannot be damaged.

The abovementioned objects of the present invention can be achieved by a cleaning apparatus for a recording apparatus, that is an apparatus for cleaning toner remaining in a toner retaining member, comprising a cleaning member for cleaning said toner and a toner guide member for collecting the toner having been cleaned from the toner retaining member by the cleaning member, characterized in that said toner guide member is in contact with the toner retaining member and that at least the contact portion thereof is in the shape of a comb. There are some instances where the toner retaining member to be used in the present invention is a charge retaining member capable of forming an electrostatic latent image such as a photoconductor, an insulating material, or an intermediate toner transfer member for transferring a toner image formed on a charge retaining member to a transfer paper. In addition thereto, roller 5 shown in FIG. 2 hereof is also included in the toner retaining member of the present invention. Also, as for the recording apparatuses referred in the present invention, the examples thereof can be given as an electrophotographic copying machine or an electrostatic recording apparatus.

DETAILED DESCRIPTION OF THE PREFERRED EMBODIMENTS

Figure 1:
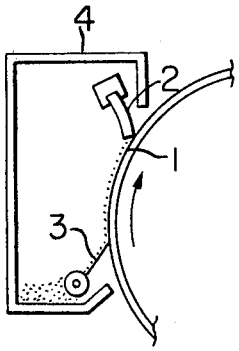
FIG. 1 PRIOR ART
FIG. 1 and FIG. 2 show the conventional types of cleaning apparatus, respectively.
Figure 2:
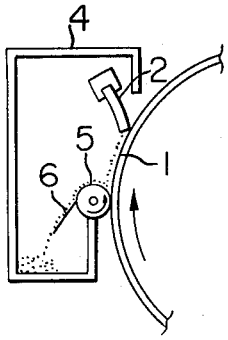
FIG. 2 PRIOR ART
Figure 3:
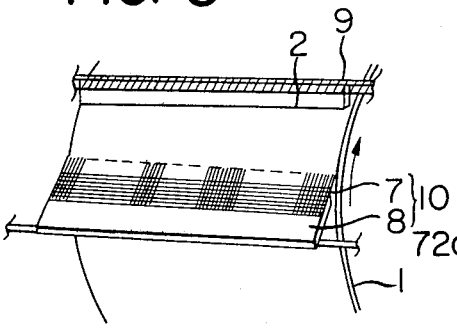
FIG. 3 shows an embodiment of the cleaning apparatus of the invention.
Figure 4:
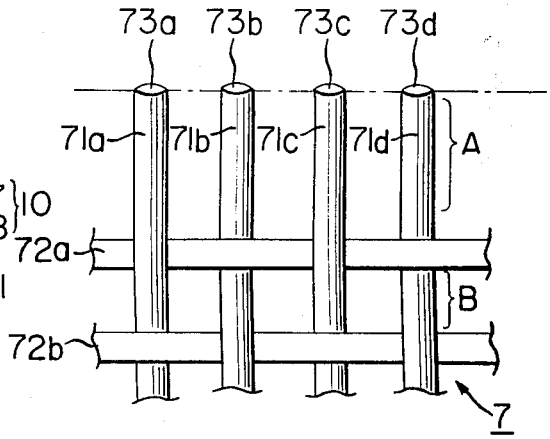
FIG. 4, FIG. 5 and FIG. 6 are enlarged segmentary views showing respectively the embodiment of the screen portion of the toner guide members of the present invention.

The present invention is illustrated from the following example:

FIG. 3 shows a cleaning apparatus embodied by the present invention, wherein the reference numerals 1 and 2 designate the same elements as in FIG. 1 and FIG. 2, numeral 9 designates a blade holding member for holding a cleaning blade made of an elastic material, 10 designates a toner guide member for collecting the toner cleaned by cleaning blade 2, and said toner guide member comprises either screen 7 and front end holding member 8, or screen 7 alone, and at least the area thereof coming into contact with a toner retaining member is formed in the shape of a comb. Screen 7 is preferably made of, for example, natural fibers such as silk, synthesized fibers such as Tetlon (Trademark Mfd by Teijin) and polypropylene, so-called semisynthesized fibers such as Rayon, or carbon fibers or coated fibers on which resins are coated, and in order to suitably soften said screen, it is preferable to make it meshy, however it is not limited to do so. FIG. 4 shows an enlarged segmentary view of an example of an area where a toner retaining member is brought into contact therewith, in the case that a meshy screen is provided to serve as screen 7.

Meshy screen 7 is brought into contact with a toner retaining member at the places designated at *73a, 73b, 73c, 73d* . . . , and each of the designation, *71a, 71b, 71c, 71d, 72a, 72b*, . . . shows a fiber respectively forming a meshy screen. If portion A in FIG. 4 is made longer than portion B, portion A increases its softness and flexibility and the possibility of damaging a toner retaining member is decreased, and further, should the so-called wavy phenomenon be caused on front end holding member 8 or on the screen in itself, there is no danger of toner leakage because the comb-shaped portions, *71a, 71b, 71c, 71d*, . . . of the meshy screen are brought into contact with toner retaining member 1 softly and independently.

Next, an explanation is now made regarding the cleaning apparatus of the present invention shown in FIG. 3: The toner remaining on toner retaining member 1 passes through screen 7 (mainly through the vacant spaces at the front ends of the comb-shaped portion), and is cleaned by cleaning blade 2, and then drops along toner retaining member 1. Thus, dropped toner is guided by screen 7 at the front end of toner guide member 10 to the toner reservoir. At this point of time, the toner having been cleaned is in a secondary cohesion state. Therefore, it is possible to effectively prevent the toner from leaking downward, even if each vacant space of the comb-shaped portion of the toner guide member should be larger than the grain diameter of the toner. Table 1 shows the toner collection performance of the cleaning apparatus of the present invention. The leakage amount of toner is converted into a relative amount, considering that the leakage amount caused by conventional technology is designated by the numeral one.

TABLE 1

| | Guide member | Material of the comb-teeth shaped guide member | Space of the comb-teeth shaped guide member | Toner leakage |
|---|---|---|---|---|
| Example in conventional technology | Mylar sht., thickness: 0.1 mm | | | 1 |
| Example 1 in the invention | Comb-teeth shaped | Silk | 77 μm | 1/10 |
| Example 2 in the invention | Comb-teeth shaped | Tetlon | 114 μm | 1/15 |
| Example 3 in the invention | Comb-teeth shaped | Tetlon | 180 μm | 1/20 |
| Example 4 in the invention | Comb-teeth shaped | Silk | 236 μm | 1/5 |

Figure 6:
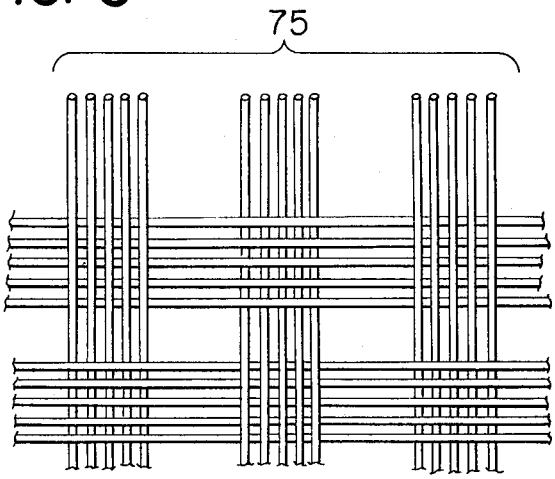
Figure 5:
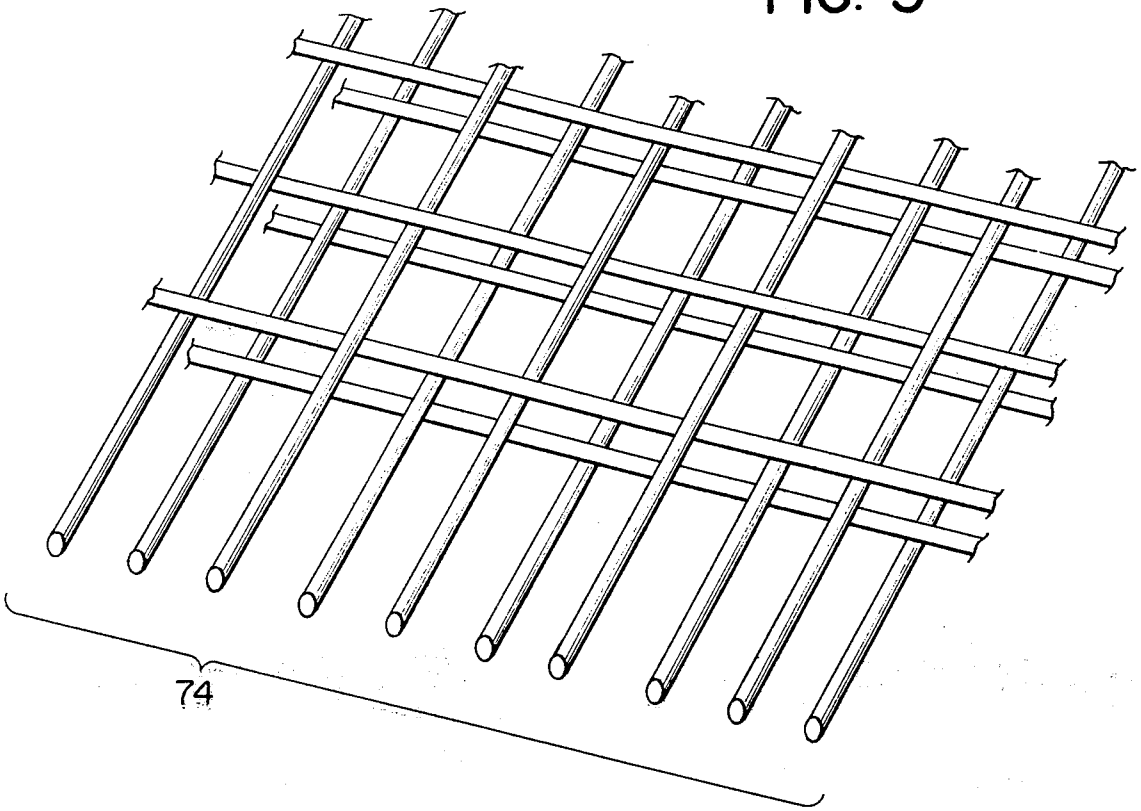

As shown in Table 1, even if the vacant spaces between the teeth of comb-shaped portion of the toner guide member, are larger than the grain diameter (approx. 7–15 μm, normally) of toner it is possible to prevent effectively the toner from leaking downward, because the toner having been cleaned is secondarily cohered. In addition, screens as shown in FIG. 5 and FIG. 6 have similar effects also and can effectively be used in the present invention. FIG. 5 shows an example embodied in the case that many meshy screens, (two of them shown therein) are laid one on top of another, and FIG. 6 shows an example of a meshy screen which is woven of each five lines of fibers as a unit. The portions designated by the reference numerals 74 and 75 are brought into contact with a toner retaining member.

Regarding said examples, the explanations have been made about a cleaning blade only, as a cleaning member. However, it is also effective for the invention to use other types of means such as web type means or roller type means, besides the above given.

As stated above, according to the invention, it is possible to effectively prevent the toner having been cleaned from the toner retaining member from leaking. Further, there can be to damage on a toner retaining member, because the comb-teeth shaped portion of a toner guide member is formed of soft fibers or the like, as mentioned above.

Further, each front end of the comb-teeth shaped portions of a toner guide member is brought into contact with a toner retaining member independently. Therefore, there is no poor contact with a toner retaining member caused by the so-called wavy phenomenon or the like. Also, there is to damage on the toner retaining member caused by trapped adhesion and cohesion of said toner on a toner guide member itself, and further there is no danger that the toners is scraped by the toner guide member. In addition thereto, it is easy to manufacture the toner guide member, because high preciseness for the process thereof is not required. The fitting of the toner guide member is also easy, because high preciseness for fitting thereof is not required. Also, the construction of the whole cleaning means is simple, and therefore many advantages can be enjoyed in making the means compact in size and the cost thereof lower.

What is claimed is:

1. A cleaning apparatus for a recording apparatus which includes a photosensitive toner retaining member and a toner collection means, the cleaning apparatus comprising:

means for cleaning toner remaining on the photosensitive toner retaining member; and a toner guide member having a plurality of spaced apart flexible front contact end portions in contact with said photosensitive toner retaining member for guiding said toner which is cleaned from said photosensitive toner retaining member to said toner collection means, at least the flexible front contact end portions of said toner guide member which are in contact with said photosensitive toner retaining member being in a comb-teeth shape.

2. A cleaning apparatus according to claim 1, wherein said cleaning means comprises an elastic cleaning blade.

3. A cleaning apparatus according to claim 1, wherein said toner retaining member is a charge retaining member.

4. A cleaning apparatus according to claim 3, wherein said charge retaining member is a photoconductive member.

5. A cleaning apparatus according to claim 1, wherein at least the front contact end portions of the comb-teeth shaped portion of said toner guide member comprise spaces apart fibers, said spaces apart fibers being individually in contact with said toner retaining member.

6. A cleaning apparatus according to claim 5, wherein said toner guide member further comprises a member for holding said comb teeth portion.

7. A cleaning apparatus according to claim 1, wherein said toner guide member comprises a plurality of woven fibers, and said plurality of spaced apart front contact end portions comprises projections extending from woven portions of said toner guide member.

8. A cleaning apparatus according to claim 7, wherein said woven fibers of said toner guide member comprise a substantially flat woven screen with said spaced apart front contact end portions extending from said screen.

9. A cleaning apparatus according to claim 8, wherein said woven fibers are soft fibers.

10. A cleaning apparatus according to claim 7, wherein said woven fibers are soft fibers.

11. A cleaning apparatus according to claim 7, wherein said toner guide member comprises a holding member coupled to said woven fibers for supporting said woven fibers at a side of said woven fibers opposite said projections.

12. A cleaning apparatus according to claim 1, wherein said spaced apart flexible front contact end portions are soft fiber members.

13. A cleaning apparatus according to claim 1, wherein said toner guide member is a substantially flat member from which said flexible front contact end portions extend, said toner retaining member being moveable relative to said toner guide member and relative to said toner cleaning means, said toner guide member being arranged at an acute angle relative to said toner retaining member as viewed in the direction of relative movement.

14. A cleaning apparatus according to claim 13, wherein said toner retaining member comprises a rotatable photosensitive drum, and wherein said toner guide member is arranged adjacent a substantially vertical portion of the photosensitive drum such that toner removed from said photosensitive drum is guided along said toner guide member by gravity.

* * * * *

UNITED STATES PATENT AND TRADEMARK OFFICE

CERTIFICATE OF CORRECTION

PATENT NO. : 4,417,807

DATED : November 29, 1983

INVENTOR(S) : Yoshio YAMAZAKI, et al

It is certified that error appears in the above—identified patent and that said Letters Patent is hereby corrected as shown below:

COLUMN 5, line 44, after "there can be" change "to damage on" to --no damage to--;

line 53, after "Also, there is" change "to damage on" to --no damage to--;

COLUMN 6 (claim 5), line 25, change "spaces" (both occurrences) to --spaced--.

Signed and Sealed this

*Eleventh* Day of *September 1984*

[SEAL]

*Attest:*

*Attesting Officer*

GERALD J. MOSSINGHOFF

*Commissioner of Patents and Trademarks*